US009112313B2

(12) United States Patent
Kanda

(10) Patent No.: US 9,112,313 B2
(45) Date of Patent: Aug. 18, 2015

(54) SHIELDED CONNECTOR

(71) Applicant: Yazaki Corporation, Minato-ku, Tokyo (JP)

(72) Inventor: Hidenori Kanda, Makinohara (JP)

(73) Assignee: Yazaki Corporation, Tokyo (JP)

( * ) Notice: Subject to any disclaimer, the term of this patent is extended or adjusted under 35 U.S.C. 154(b) by 52 days.

(21) Appl. No.: 13/920,453

(22) Filed: Jun. 18, 2013

(65) Prior Publication Data

US 2013/0344737 A1 Dec. 26, 2013

(30) Foreign Application Priority Data

Jun. 20, 2012 (JP) ..... 2012-139019

(51) Int. Cl.

| | |
|---|---|
| ***H01R 4/10*** | (2006.01) |
| ***H01R 13/6592*** | (2011.01) |
| ***H01R 9/05*** | (2006.01) |
| *H01R 4/18* | (2006.01) |

(52) U.S. Cl.

CPC ..... *H01R 13/6592* (2013.01); *H01R 9/0518* (2013.01); *H01R 4/185* (2013.01)

(58) Field of Classification Search

USPC ..... 439/58, 877

See application file for complete search history.

(56) References Cited

U.S. PATENT DOCUMENTS

| | | | | |
|---|---|---|---|---|
| 4,609,242 | A * | 9/1986 | Kemppainen | 439/78 |
| 7,140,914 | B2 * | 11/2006 | Kojima | 439/585 |
| 2005/0287875 | A1 | 12/2005 | Kojima | |

FOREIGN PATENT DOCUMENTS

| | | | |
|---|---|---|---|
| CN | 201797171 | U | 4/2011 |
| JP | 2000133403 | A | 5/2000 |
| JP | 2006-310135 | A | 11/2006 |

OTHER PUBLICATIONS

Communication issued on Feb. 27, 2015 by The State Intellectual Property Office of the PR of China in related application No. 201310244345.7.

* cited by examiner

*Primary Examiner* — Phuong Dinh

(74) *Attorney, Agent, or Firm* — Sughrue Mion, PLLC

(57) ABSTRACT

A shielded connector adapted to be connected to a terminal of a shielded electrical cable provided with an insulator, an outer conductor and a sheath around an inner conductor in this order includes an inner terminal that is connected to the inner conductor, an insulating member that covers the inner terminal, and an outer terminal that is connected to the outer conductor. The outer terminal includes a cylindrical-shaped shield portion that covers the insulating member, a crimping portion, and a connection portion that connects the shield portion with the crimping portion. The connection portion includes a bottom plate part and side wall parts erected from both sides of the bottom plate part, and the side wall parts have upper ends having a height equal to or larger than a center line of the outer terminal.

1 Claim, 8 Drawing Sheets

SHIELDED CONNECTOR

CROSS REFERENCE TO RELATED APPLICATION

This application is based on Japanese Patent Applications No. 2012-139019 filed on Jun. 20, 2012, the contents of which are incorporated herein by reference.

BACKGROUND OF THE INVENTION

1. Technical Field

The present invention relates to a shielded connector adapted to be connected to a shielded electrical cable.

2. Background Art

As shown in FIG. 5, a shielded connector 111 adapted to be connected to a shielded electrical cable 105, in which a shield conductor 103 is covered around a signal conductor 101 with an insulator 102 interposed therebetween and a sheath 104 is coved around an outer circumference of the shield conductor 103, is known (see JP-A-2006-310135). In the shielded connector 111, an inner conductor terminal 112 is connected to a terminal of the signal conductor 101, the inner conductor terminal 112 is received in a generally cylindrical-shaped tubular receiving portion 115 of an outer conductor terminal 114 with a dielectric 113 interposed therebetween, and also the outer conductor terminal 114 is connected to the shield conductor 103 of the shield electrical cable 105.

As shown in FIGS. 6 to 8, the shielded connector 111 is connected to the shielded electrical cable 105 by crimping a shield conductor crimping portion 116 of the outer conductor terminal 114 against the shield conductor 103 of the shielded electrical cable 105. However, when a portion of the shield conductor 103 is pressed, there is a case in which the shield conductor 103 located more toward a distal end thereof than the shield conductor crimping portion 116 is loosened and spread. Such a loosened shield conductor 103 is hardly caught on an edge on a distal end of the shield conductor crimping portion 116, thereby causing reduction of a fixation strength in the shield conductor crimping portion 116.

In addition, if a crimping force of the shield conductor crimping portion 116 is increased to obtain a fixation strength, the signal conductor 101 of the shielded electrical cable 105 at the crimping position is strongly compressed, and thus there is a possibility of causing problems, such as breaking of a wire.

Accordingly, the present invention has been made keeping in mind the above problems, and an object of the invention is to provide a shielded connector, which is crimped against a shielded electrical cable without problems, thereby achieving a good connection state.

SUMMARY OF THE INVENTION

To achieve the above object, a shielded connector according to the present invention is characterized by the following (1).

(1) According to an aspect of the invention, a shielded connector adapted to be connected to a terminal of a shielded electrical cable provided with an insulator, an outer conductor and a sheath around an inner conductor in this order includes an inner terminal that is connected to the inner conductor, an insulating member that covers the inner terminal, and an outer terminal that is connected to the outer conductor. The outer terminal includes a cylindrical-shaped shield portion that covers the insulating member, a crimping portion that is crimped against the outer conductor, and a connection portion that connects the shield portion with the crimping portion. The connection portion includes a bottom plate part and side wall parts erected from both sides of the bottom plate part at least on a crimping portion side of the bottom plate part, and the side wall parts have upper ends having a height equal to or larger than a center line of the outer terminal.

According to the shielded connector of the configuration of the above (1), the connection portion for connecting the shield portion with the crimping portion is provided with the side wall parts having a height equal to or higher than the center line of the outer terminal and being erected from both sides of the bottom plate part. Accordingly, upon crimping the crimping portion, a terminal of the outer conductor is pressed by the side wall parts, and as a result, decrease of a fixation strength in the crimping portion due to lateral loosening of the terminal of the outer conductor upon crimping is inhibited.

Therefore, a sufficient fixation strength in the crimping portion is obtained without increasing a crimping force, and a compression of the inner conductor at the crimping position caused by increasing the crimping force is inhibited as far as possible. As a result, the shielded connector is connected to the shielded electrical cable without problems, such as breaking of the inner conductor.

According to the present invention, a shielded connector, which is pressed against a shielded electrical cable without problems and thus achieve a good connection state, is provided.

In the foregoing, the present invention has been briefly described. Also, details of the present invention will be further apparent, when modes (hereinafter, referred to as "embodiments") for embodying the invention as described below are thoroughly read with reference to the accompanying drawings.

DESCRIPTION OF EMBODIMENTS

An example of an embodiment of the present invention will be now described with reference to the accompanying drawings.

Figure 1:
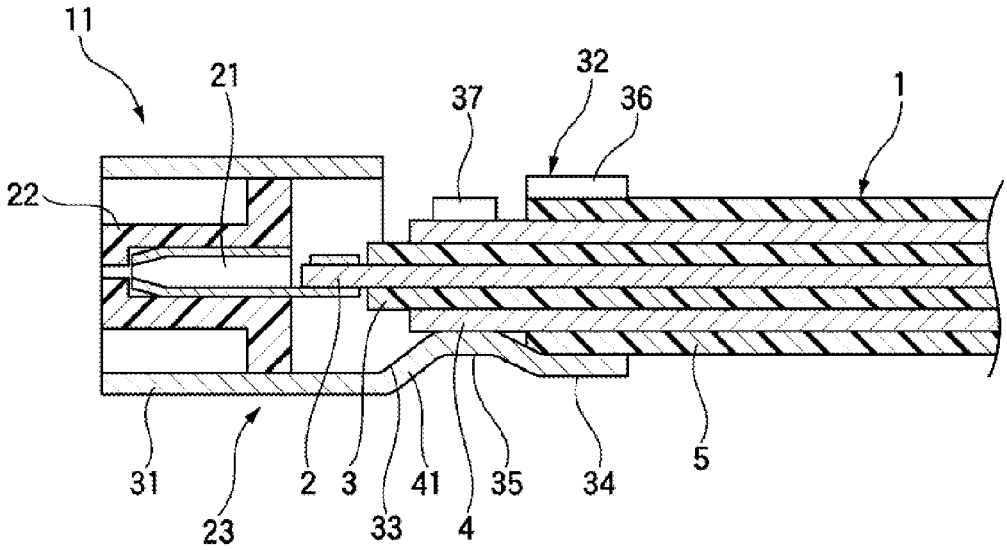
FIG. 1 is a sectional view showing a shielded connector according to the present embodiment.
Figure 2:
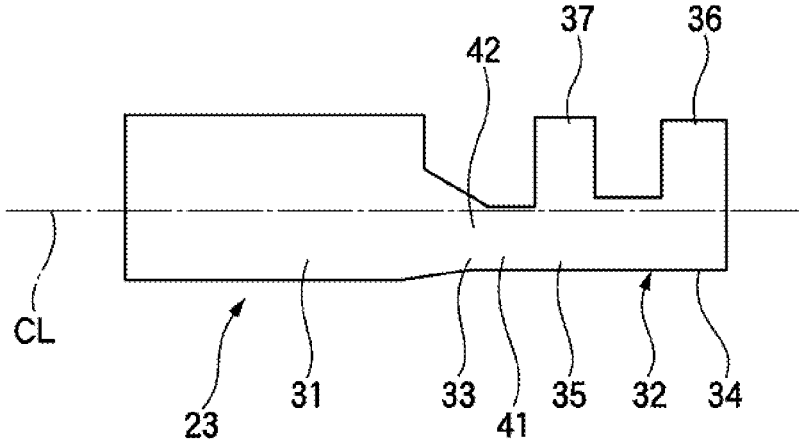
FIG. 2 is a side view showing an outer terminal constituting the shielded connector according to the embodiment.
Figure 3:
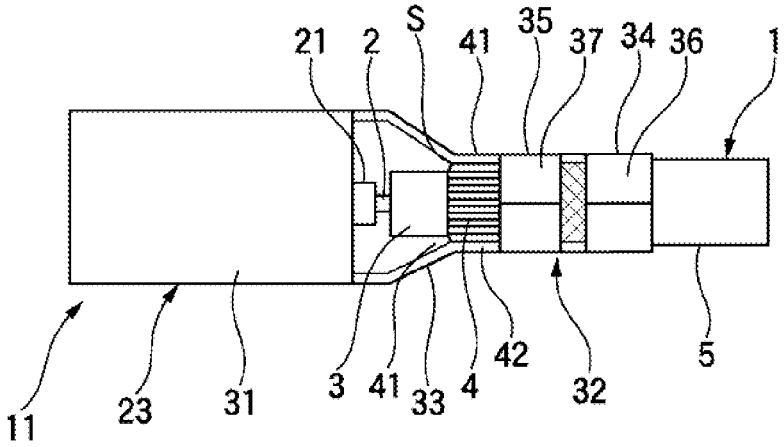
FIG. 3 is a plan view showing the shielded connector according to the embodiment connected to a shielded electrical cable.
Figure 4:
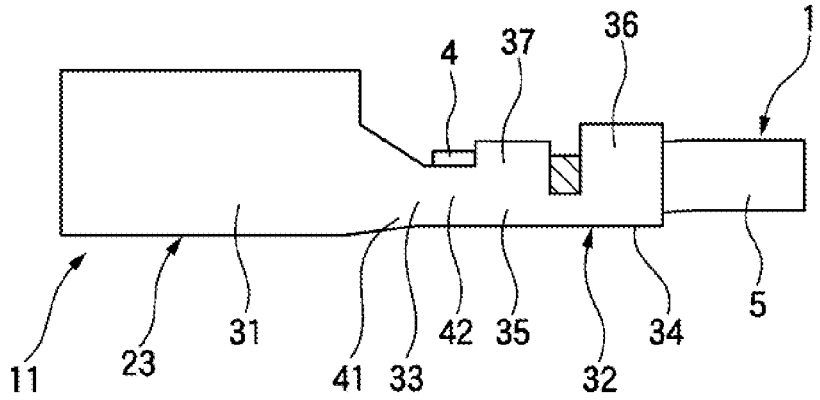
FIG. 4 is a side view showing the shielded connector according to the embodiment connected to the shielded electrical cable.
Figure 5:
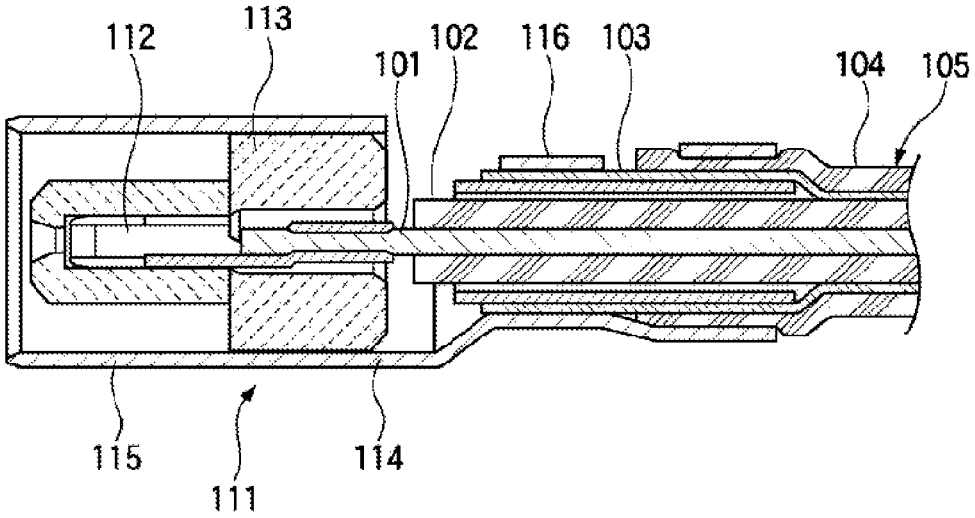
FIG. 5 PRIOR ART
FIG. 5 is a sectional view showing a shielded connector according to the related art.
Figure 6:
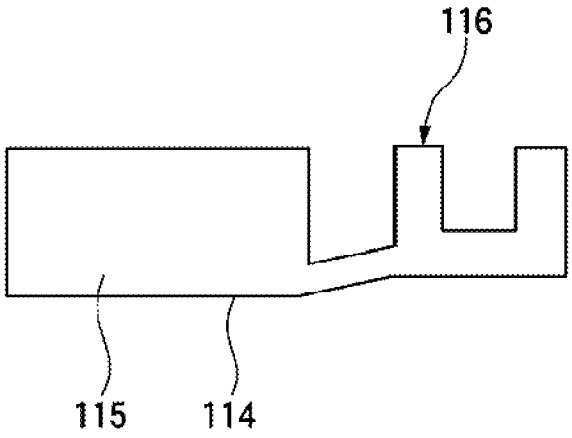
FIG. 6 PRIOR ART
FIG. 6 is a side view showing an outer terminal constituting the shielded connector according to the related art.
Figure 7:
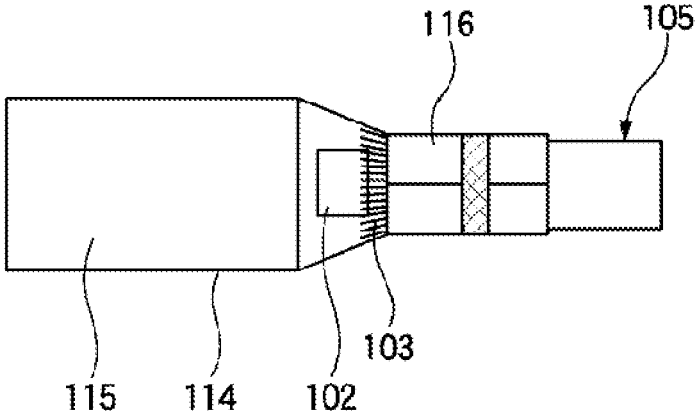
FIG. 7 PRIOR ART
FIG. 7 is a plan view showing the shielded connector according to the related art connected to a shielded electrical cable.
Figure 8:
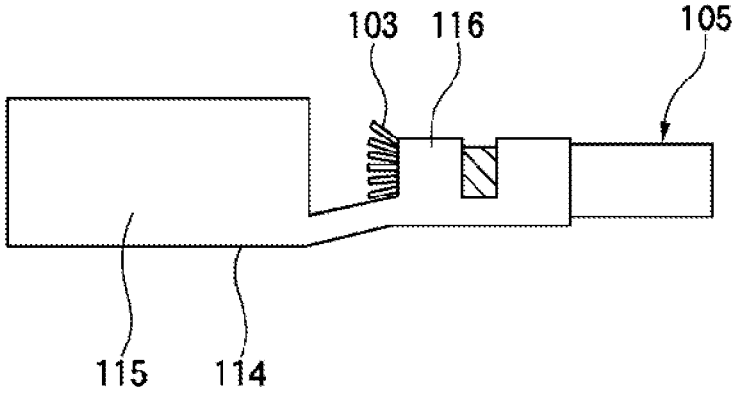
FIG. 8 PRIOR ART
FIG. 8 is a side view showing the shielded connector according to the related art connected to the shielded electrical cable.

FIG. 1 is a sectional view showing a shielded connector according to the present embodiment, FIG. 2 is a side view showing an outer terminal constituting the shielded connector according to the embodiment, FIG. 3 is a plan view showing the shielded connector according to the embodiment connected to a shielded electrical cable, and FIG. 4 is a side view showing the shielded connector according to the embodiment connected to the shielded electrical cable.

As shown in FIG. 1, the shielded connector 11 according to the present embodiment is connected to a terminal of the shielded electrical cable 1. The shielded electrical cable 1 includes an inner conductor 2, an insulator 3 extending in a longitudinal direction of the inner conductor 2 while surrounding an outer circumferential surface of the inner conductor 2, an outer conductor 4 extending in the longitudinal direction while surrounding an outer circumferential surface of the insulator 3 and formed by braiding or the like, and a sheath 5 extending in the longitudinal direction while surrounding an outer circumferential surface of the outer conductor 4.

In the shielded electrical cable 1, the inner conductor 2, the insulator 3 and the outer conductor 4 are exposed at a terminal portion thereof connected to the shielded connector 11.

The shielded connector 11 according to the present embodiment connected to the terminal of the shielded electrical cable 1 includes an inner terminal 21, an insulating member 22 and an outer terminal 23.

The inner terminal 21 is formed of a conductive metal plate and is connected to the inner conductor 2. The insulating member 22 is formed of a resin or the like, and is inserted outside of the inner conductor 2. The outer terminal 23 is formed of a conductive metal plate and is connected to the outer conductor 4.

As shown in FIGS. 2 to 4, the outer terminal 23 includes a shield portion 31, a crimping portion 32, and a connection portion 33 for connecting the shield portion 31 with the crimping portion 32.

The shield portion 31 is formed in a cylindrical shape, and the insulating member 22 inserted outside of the inner terminal 21 is received in the shield portion 31.

The crimping portion 32 includes a cable crimping part 34 and a shield crimping part 35. The cable crimping part 34 has a pair of cable crimping pieces 36, and the cable crimping pieces 36 are crimped and thus are inwardly pressed and deformed so that an end portion of the shielded electrical cable 1 is crimped. Also, the shield crimping part 35 has a pair of shield crimping pieces 37, and the shield crimping pieces 37 are crimped and thus are inwardly pressed and deformed so that a portion of the outer conductor 4 of the shielded electrical cable 1, which is exposed from the sheath 5, is crimped.

The connection portion 33 for connecting the shield portion 31 with the crimping portion 32 includes a bottom plate part 41 and side wall parts 42 erected from both sides of the bottom plate part 41, and the side wall parts 42 are integrally formed with the shield crimping part 35 of the crimping portion 32 and the shield portion 31. The side wall parts 42 have upper ends having a height position equal to or higher than the center line CL of the outer terminal 23. The center line CL is a straight line which passes through the center point of the outer terminal 23 in a height direction thereof and extends in a longitudinal direction of the outer terminal 23. As a result, the connection portion 33 is provided with a conductor receiving space S surrounded by the bottom plate part 41 and the side wall parts 42. A distal end of the outer conductor 4 of the shield electrical cable 1, which is exposed from the sheath 5, is received in the conductor receiving space S.

Next, the procedure of connecting the shielded connector 11 according to the embodiment of the present invention to the shielded electrical cable 1 will be described.

Firstly, by terminal-treating the shielded electrical cable 1, the inner conductor 2, the insulator 3, and the outer conductor 4 are exposed in sequence.

Also, the inner conductor 2 is inserted in the inner terminal 21 and then the inner terminal 21 is crimped, thereby connecting the inner terminal 21 to the inner conductor 2.

Subsequently, the inner terminal 21 is inserted in the insulating member 22 fitted in the shield portion 31 of the outer terminal 23, and then, portions of the outer conductor 4 and the sheath 5 of the shielded electrical cable 1 are disposed in the shield crimping part 35 and the cable crimping part 34 of the crimping portion 32.

In this state, the shield crimping pieces 37 of the shield crimping part 35 and the cable crimping pieces 36 of the cable crimping part 34 are crimped by a crimping machine. By doing so, the portion of the outer conductor 4 of the shielded electrical cable 1 is crimped by the shield crimping part 35 in the crimping portion 32 of the outer terminal 23, and the portion of the sheath 5 is crimped by the cable crimping part 34. Therefore, at the terminal of the shielded electrical cable 1, the outer terminal 23 is connected with the outer conductor 4 in a conductive state, and as a result, the shielded connector 11 is connected to the terminal of the shielded electrical cable 1.

In this case, the connection portion 33 for connecting the shield portion 31 with the crimping portion 32 is provided with the side wall parts 42 having a height equal to or higher than the center line CL of the outer terminal 23 and being erected from both sides of the bottom plate part 41, and thus is provided with the conductor receiving space S surrounded by the side wall parts 42.

Therefore, when the outer conductor 4 of the shielded electrical cable 1 is disposed in the shield crimping part 35 of the crimping portion 32, the terminal of the outer conductor 4, which is protruded toward the shield portion 31 relative to the shield crimping portion 35, is disposed in the conductor receiving space S surrounded by the side wall parts 42. Therefore, even if the crimping portion 32 is crimped in this state so that the outer conductor 4 is crimped by the shield crimping part 35, lateral sides of the terminal of the outer conductor 4 are pressed by the side wall parts 42, thereby keeping the outer conductor 4 in a bundle state without being loosened. In addition, the outer conductor 4 kept in a bundle state without being loosened is caught on an edge of the shield crimping part 35 of the crimping portion 32 facing the shield portion 31, thereby obtaining a sufficient fixation strength in the shield crimping part 35. As a result, decrease of the fixation strength in the crimping portion 32 due to lateral loosening of the terminal of the outer conductor 4 upon crimping the crimping portion 32 is inhibited.

As described above, according to the shielded connector 11 of the foregoing embodiment, the connection portion 33 for connecting the shield portion 31 with the crimping portion 32 is provided with the side wall parts 42 having a height equal to or higher than the center line CL of the outer terminal 23 and being erected from both sides of the bottom plate part 41. Accordingly, upon crimping the crimping portion 2, the terminal of the outer conductor 4 is pressed by the side wall parts 42, and as a result, decrease of the fixation strength in the crimping portion 32 due to lateral loosening of the terminal of the outer conductor 4 upon crimping is inhibited.

Therefore, a sufficient fixation strength in the crimping portion 32 is obtained without increasing a crimping force, and a compression of the inner conductor 2 at the crimping position caused by increasing the crimping force is inhibited as far as possible. As a result, the shielded connector 11 is connected to the shielded electrical cable 1 without problems, such as breaking of the inner conductor 2.

The present invention is not limited to the foregoing embodiment, but appropriate changes, modifications or the like thereof is made. In addition, material, shape, dimension, number, installation location and the like of each of the components of the foregoing embodiment are not limited but arbitrary as long as the present invention is achieved.

What is claimed is:

1. A shielded connector adapted to be connected to a terminal of a shielded electrical cable provided with an insulator, an outer conductor and a sheath around an inner conductor in this order, the shield connector comprising:

an inner terminal that is connected to the inner conductor;

an insulating member that covers the inner terminal; and an outer terminal that is connected to the outer conductor, wherein the outer terminal comprises:

a shield portion that covers the insulating member;

a crimping portion that is crimped against the outer conductor; and a connection portion that connects the shield portion with the crimping portion, wherein the connection portion includes a bottom plate part and side wall parts erected from both sides of the bottom plate part at least on a crimping portion side of the bottom plate part, and the side wall parts have upper ends having a height equal to or larger than a center line of the outer terminal, and wherein the side wall parts do not contact one another while pressing the outer conductor.

* * * * *